United States Patent [19]

Bommaraju et al.

[11] 4,358,353

[45] Nov. 9, 1982

[54] METHOD FOR EXTENDING CATHODE LIFE

[75] Inventors: Tilak V. Bommaraju, Grand Island; Krishnan Viswanathan, Niagara Falls, both of N.Y.

[73] Assignee: Occidental Chemical Corporation, Niagara Falls, N.Y.

[21] Appl. No.: 265,739

[22] Filed: May 21, 1981

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS 4,146,445 3/1979 Cook et al. ..... 204/98

*Primary Examiner*—R. L. Andrews

*Attorney, Agent, or Firm*—James F. Tao; William G. Gosz

[57] ABSTRACT

A method is provided for extending the life of transition metal-based cathodes used in chlor-alkali diaphragm cells by adding a small amount of a reducing agent, such as $Na_2SO_3$ or urea, to the electrolytic solution during periods of interrupted current flow to the cell. The reducing agent reacts with the sodium hypochlorite which is dissolved in the electrolytic solution to prevent the oxidation, and hence dissolution, of the transition metal in the cathode coating.

11 Claims, No Drawings

METHOD FOR EXTENDING CATHODE LIFE

BACKGROUND OF THE INVENTION

The present invention relates to a method for extending the life of transition metal-based cathodes used in electrolytic diaphragm-type cells. Such cathodes are advantageous due to their ease and low cost of fabrication and their low overvoltage characteristics when used, for example, in the electrolysis of aqueous solutions of alkali metal halides to produce alkali metal hydroxides and halogens.

A typical electrolytic alkali metal halide cell is an enclosed container which is physically partitioned into at least two distinct regions or chambers by means of a permeable intermediate barrier or cell separator, such as an asbestos diaphragm or synthetic microporous separator. During the electrolysis of an alkali metal halide solution, hydrogen and alkali metal hydroxide are formed at the cathode while chlorine and oxygen are formed at the anode. When the alkali metal is sodium, the electrolytic solution in the cathode compartment, i.e. the catholyte, may contain approximately 12%–17% NaOH, 15%–20% NaCl, and negligible, e.g. about 10 p.p.m., NaOCl. Under conditions of normal operation, sodium hypochlorite will generally not cause deterioration of the cathode coating material. However, when the current flow to the cell is interrupted, such as when the cell is subjected to routine maintenance during a shutdown period, the concentration of sodium hypochlorite in the catholyte increases significantly to amounts of up to 2 gms./liter or more. Such concentrations of sodium hypochlorite can have an immediate adverse effect on the transition metals contained in the cathode, causing such metals to dissolve in the solution and ultimately leading to the failure of the cathode coating. "Transition metal", in the context of the present invention, includes iron, cobalt, nickel, their oxides and combinations of alloys thereof.

The rapid increase in sodium hypochlorite concentration in the catholyte during periods of current interruption is caused by the convective flow and diffusion of hypochlorite ions from the anolyte. At the cathode, the sodium hypochlorite is reduced to sodium chloride and water as follows:

$$NaOCLl + 2H^+ + 2e^- \rightarrow NaCl + H_2O \quad (1)$$

The corresponding oxidation of the cathode transition metal, illustrated below by nickel, can be designated as follows:

$$Ni \rightarrow Ni^{++} + 2e^- \quad (2)$$

The overall reaction can thus be designated as:

$$Ni + NaOCl + 2H^+ \rightarrow Ni^{++} + NaCl + H_2O \quad (3)$$

The nickel in the cathode is thus ionized and becomes soluble in the catholyte causing dissolution of the coating.

In recent years, increasing attention has been directed toward improving the hydrogen overvoltage characteristics of electrolytic cell cathodes. In addition to having a reduced hydrogen overvoltage, a cathode should also be constructed from materials that are inexpensive, easy to fabricate, mechanically strong, and capable of withstanding the environmental conditions of the electrolytic cell. Iron or steel fulfills many of these requirements, and has been the traditional material used commercially for cathode fabrication in the chlor-alkali industry. However, since steel cathodes generally exhibit overvoltage in the range of from about 300 to 500 millivolts under typical cell operating conditions, i.e. at a temperature of about 90° C. and a current density of from 100 to 200 milliamperes per square centimeter, efforts have focused on improved cathode coatings having significantly reduced hydrogen overvoltage.

Various coating materials have been suggested to improve the hydrogen overvoltage characteristics of electrolytic cell cathodes in an economically viable manner. A significant number of the prior art coatings have included transition metals other than iron or steel, such as cobalt and nickel, or mixtures, alloys or intermetallic compounds of these metals with various other metals. Frequently, when nickel is employed in admixture with another metal or compound, the second metal or compound can be leached or extracted in a solution of, for example, sodium hydroxide, to provide high surface area coatings, such as Raney nickel coatings.

Copending application Ser. No. 104,235, filed Dec. 17, 1979, discloses a low hydrogen overvoltage cathode having an active surface layer comprising, as a preferred embodiment thereof, a codeposit of nickel, molybdenum or an oxide thereof, and cadmium. Other transition metal-based cathode coatings are disclosed in U.S. Pat. No. 4,105,532, issued Aug. 8, 1978, and U.S. Pat. No. 4,152,240, issued May 1, 1979, which relate to cathodes comprising, respectively, alloys of nickel-molybdenum-vanadium and nickel-molybdenum using specially selected substrate and intermediate coatings of copper and/or dendritic copper. Similar coatings are also disclosed in U.S. Pat. Nos. 4,033,837 and 3,291,714.

U.S. Pat. No. 4,055,476, issued Oct. 24, 1977, discloses the continuous addition of nickel-based catalysts to an electrolytic diaphragm cell brine feed to prevent the formation of chlorates in the cell by decomposing sodium hypochlorite. Other reagents which are disclosed as being useful for this purpose include hydrochloric acid, sodium tetrasulfide, and various nickel and cobalt compounds. However, this patent does not recognize the utility of any of the above-mentioned materials for the prevention of cathode dissolution during periods of current interruption or cell shutdown.

Under typical commercial operating conditions of the chloralkali industry, it is not unusual for the operator of the cell to experience periods of interrupted current as frequently as once a month or more. The frequency of such shutdown periods thus poses a serious problem to the durability and maintenance of transition metal-based cathodes used in commercial cells. It will therefore be readily appreciated that a need exists for protecting such cathodes against the corrosive effects of sodium hypochlorite during shutdown periods.

SUMMARY OF THE INVENTION

In accordance with the present invention, there is provided a method for extending the life of transition metal-based cathodes used in chlor-alkali diaphragm cells by substantially reducing the quantity of sodium hypochlorite present in the catholyte of such cells during shutdown periods. This is accomplished by adding an effective amount of a suitable reducing agent, such as an alkali metal sulfite, urea, or mixtures thereof, to the electrolyte during or preceding periods of interrupted current flow to the cell. Preferably, the reducing agent is added in amount sufficient to establish a concentration of generally from about 2 to about 11 grams/liter in the catholyte solution of the cell.

DETAILED DESCRIPTION OF THE INVENTION

The objects of the present invention are achieved by the addition of an effective amount of a sodium hypochlorite reducing agent to the electrolyte of the cell during or preceding periods of interrupted current flow to the cell. Suitable reducing agents for purposes of this invention include alkali metal sulfites, such as sodium sulfite, urea, and mixtures thereof.

The reducing agent can be added to either the anolyte or catholyte solution of the cell, or both if desired. As long as sufficient sodium hypochlorite is reduced to insignificant amounts in the catholyte compartment, the deterioration of the cathode can be kept minimal during shutdown periods. Optimally, in order to minimize the amount of reducing agent required to maintain the integrity of the cathode coating, the reducing agent is added to the cell catholyte or anolyte immediately preceding the shutdown period. Under these conditions, the amount of reducing agent supplied to the cell approximates the stoichiometric amount required for complete reaction with the sodium hypochlorite.

For purpose of illustration, the reaction of sodium sulfite with sodium hypochlorite is shown below:

$$NaOCl + Na_2SO_3 \rightarrow Na_2SO_4 + NaCl \quad (4)$$

The products of this reaction, sodium sulfate and sodium chloride, remain in solution and do not adversely affect the performance of the cell or the cell components, i.e. the electrodes or cell diaphragm.

If sodium sulfite is employed as the reducing agent, then, as shown by equation (4), approximately equal molar quantities of sodium sulfite and sodium hypochlorite will be required under stoichiometric conditions to completely reduce the sodium hypochlorite. Of course, greater amounts of reducing agent can be added to the electrolytic solution since excessive amounts of sodium sulfite may not be harmful to cell performance. Based on a maximum concentration of sodium hypochlorite of from about 2–6 gms./liter of electrolytic solution, effective amounts of sodium sulfite generally correspond to a solution concentration of from about 4–12 gms./liter. If the reducing agent used is urea, the effective amounts of urea generally correspond to a solution concentration of from about 2–5 gms./liter. The actual amounts of reducing agent required can be readily ascertained based on the solution capacity of the cell.

The present invention is readily applicable to a variety of commercial-scale chlor-alkali cells, such as the Hooker H-4 series of diaphragm cells. Commercial cells of this type are generally provided with a series of dimensionally stable anodes and steel or iron cathodes, with porous, asbestos diaphragms deposited on the cathode screens. Continuous means for supplying and removing chemicals to the cells are also provided. In more advanced cell designs, the use of improved energy-saving components, such as plastic reinforced asbestos diaphragms, synthetic microporous separators, and transition-metal cathodes is becoming increasingly widespread in the chlor-alkali industry. This invention is especially useful in cells employing these advanced components.

The addition of the reducing agent to the cell can be accomplished using either a batch or continuous procedure. A variety of automated process equipment can be advantageously employed to effect the addition of the reducing agent to the cell solution. Such equipment is standard in the industry, and is familiar to those skilled in the art.

The following example further illustrates and describes the various aspects of the invention, but is not intended to limit it. Various modifications can be made in the invention without departing from the spirit and scope thereof, as will be readily appreciated by those skilled in the art. Such modifications and variations are considered to be within the purview and scope of the appended claims.

EXAMPLE

A Hooker H-4/9 chlor-alkali diaphragm cell having an electrolyte comprising 15% sodium hydroxide and 17% sodium chloride is operated with a dimensionally stable anode and an iron cathode at a current density of 1.5 ASI. Sodium sulfite is fed to the cathode compartment and allowed to mix with the catholyte for 20 minutes. The current was turned off and a stoichiometric amount of sodium sulfite is added to the anolyte with $N_2$ purging.

The cell is disassembled, the cathode is removed and visually inspected. No physical damage or visible signs of deterioration of the cathode coating are observed.

What is claimed is:

1. A method for inhibiting the dissolution of nickel-containing cathodes for use in chlor-alkali diaphragm cells comprising adding an effective amount of an alkali metal sulfite to the electrolyte of said cell during or preceding periods of interrupted current flow to the cell.

2. The method of claim 1 wherein the sodium sulfite is present in the electrolyte in a concentration range of from about 4 to about 11 gms./liter.

3. The method of claim 1 wherein the transition metal is predominantly nickel.

4. The method of claim 1 wherein the alkali metal sulfite is added to the catholyte.

5. The method of claim 1 wherein the alkali metal sulfite is added to the anolyte.

6. A method for inhibiting the dissolution of transition metal-containing cathodes for use in chlor-alkali diaphragm cells comprising adding an effective amount of urea to the electrolyte of said cell during or preceding periods of interrupted current flow to the cell.

7. The method of claim 6 wherein the urea is present in the electrolyte in a concentration range of from about 2 to about 5 gms./liter.

8. The method of claim 6 wherein the transition metal is predominantly nickel.

9. The method of claim 6 wherein the transition metal is predominantly iron.

10. The method of claim 6 wherein the urea is added to the catholyte.

11. The method of claim 6 wherein the urea is added to the anolyte.

* * * * *